US005964527A

United States Patent [19]

Decnop

[11] Patent Number: 5,964,527

[45] Date of Patent: Oct. 12, 1999

[54] MIXING DEVICE

[76] Inventor: Coen Hendrik Decnop, Acaciapark 122, NL-1213 LE Hilversum, Netherlands

[21] Appl. No.: 08/920,150

[22] Filed: Aug. 26, 1997

[30] Foreign Application Priority Data

Mar. 19, 1997 [EP] European Pat. Off. ..... 97200806

[51] Int. Cl.[6] ..... B01F 15/02; B01F 9/14

[52] U.S. Cl. ..... 366/172.1; 366/172.2; 366/270

[58] Field of Search ..... 366/163.2, 164.1, 366/164.3, 168.1, 172.1, 172.2, 181.8, 181.7, 190, 262, 263, 264, 265, 270, 279, 293, 315, 317

[56] References Cited

U.S. PATENT DOCUMENTS

| | | | |
|---|---|---|---|
| 1,250,810 | 12/1917 | Dazey | 366/164.1 |
| 1,933,346 | 10/1933 | Schwentker | 366/190 |
| 2,002,000 | 5/1935 | Colburn, Jr. | 366/263 |
| 2,448,042 | 8/1948 | Miller . | |
| 2,646,346 | 7/1953 | Coplan et al. | 366/265 |
| 2,971,748 | 2/1961 | Ellegast . | |
| 3,179,380 | 4/1965 | Drayer | 366/142 |
| 3,430,925 | 3/1969 | Buhner | 366/172.2 |
| 3,623,705 | 11/1971 | Townsley | 366/172.1 |
| 3,973,759 | 8/1976 | Mizrahi et al. | 366/264 |
| 4,062,526 | 12/1977 | Green | 366/264 |
| 4,075,089 | 2/1978 | Saari et al. | 366/264 |
| 4,155,657 | 5/1979 | King et al. | 366/172.2 |
| 4,434,942 | 3/1984 | Cardini . | |
| 4,610,547 | 9/1986 | Bennett et al. | 366/293 |
| 5,628,563 | 5/1997 | Fisher | 366/270 |

FOREIGN PATENT DOCUMENTS

| | | |
|---|---|---|
| 0328154 | 8/1989 | European Pat. Off. . |
| 93948 | 11/1972 | Germany . |
| 998329 | 9/1965 | United Kingdom . |

*Primary Examiner*—Tony G. Soohoo

*Attorney, Agent, or Firm*—Webb, Ziesenheim, Logsdon, Orkin & Hanson, P.C.

[57] ABSTRACT

A device for mixing a carrier liquid with one or more additives comprising a closed housing with a non-circular cross section and with an inlet and an outlet opening for the liquid and an infeed port for each additive in addition to a mixing gear accommodated therein. The mixing gear is formed by at least one rotatingly driven blade assembly having a rotation shaft which is received centrally in the housing. The mixing gear exerts a pushing action on the liquid in the direction toward the inlet opening, whereby due to a vigorous shearing action between the generated liquid flows each additive is thoroughly mixed.

17 Claims, 3 Drawing Sheets

MIXING DEVICE

BACKGROUND OF THE INVENTION

The invention relates to a device for mixing a carrier liquid with one or more additives comprising a closed housing with an inlet and an outlet opening for the liquid and an infeed port for each additive in addition to a mixing gear accommodated therein.

Such a mixer is applied in many processes. Using for instance static mixers, in which a carrier liquid is transported along a static body together with a pre-admitted additive such that mixing takes place as a result of the differing flows between additive and carrier liquid. For particular additive substances this does not work well and use is therefore often made of active mixers in the form of a fixed quantity of carrier liquid which is mixed with the additive in a vessel by means of a stirring apparatus. The drawback here is that a fixed quantity of liquid is mixed at a time, this being disadvantageous for continuous processes.

The invention has for its object to provide a device with which a continuous mixing process is realized with a considerably higher efficiency so that greater mixing is brought about, even for substances which are difficult to mix.

SUMMARY OF THE INVENTION

The device according to the invention is distinguished in that the mixing gear is formed by at least one rotatingly driven blade assembly, having a rotation shaft which is received centrally in the cross sectionally non-circular housing, wherein the mixing gear exerts a pushing action on the liquid in the direction toward the inlet opening.

Due to the counterflow effect of the stirring apparatus on the carrier liquid there occurs in the mixing housing on the one hand a flow in the main flow direction and on the other a partial-flow in the opposing direction whereby the additive is mixed vigorously with the carrier liquid. Because of the non-circular form of the housing the main flow will be situated along the outside of the housing while the counterflow takes place centrally in the housing. Good mixing of the substances results from the vigorous shearing action between both flows.

The port for the additive is preferably arranged in the side wall of the housing, i.e. it is directly entrained in the main flow which is subsequently fed back into the counterflow in the central part. It is herein also possible to introduce the additive via a guide tube directed from the port toward the central shaft so that this additive directly enters the counterflow.

If the blade assembly is constructed from two groups of blades which are fixed at a mutual distance to the rotation shaft thereof, it is recommended to have the guide tube debouch on the side of at least the leading blade assembly remote from the feed opening for the carrier liquid.

In a further development the leading blade assembly consists of a part which has an axial pushing action and a part which has a radial pushing action. Intensive mixing is hereby improved still further.

BRIEF DESCRIPTION OF THE DRAWINGS

Above mentioned and other features of the invention will be further elucidated hereinbelow in the figure description of two embodiments. In the drawings.

DESCRIPTION OF THE PREFERRED EMBODIMENTS

Figure 1:
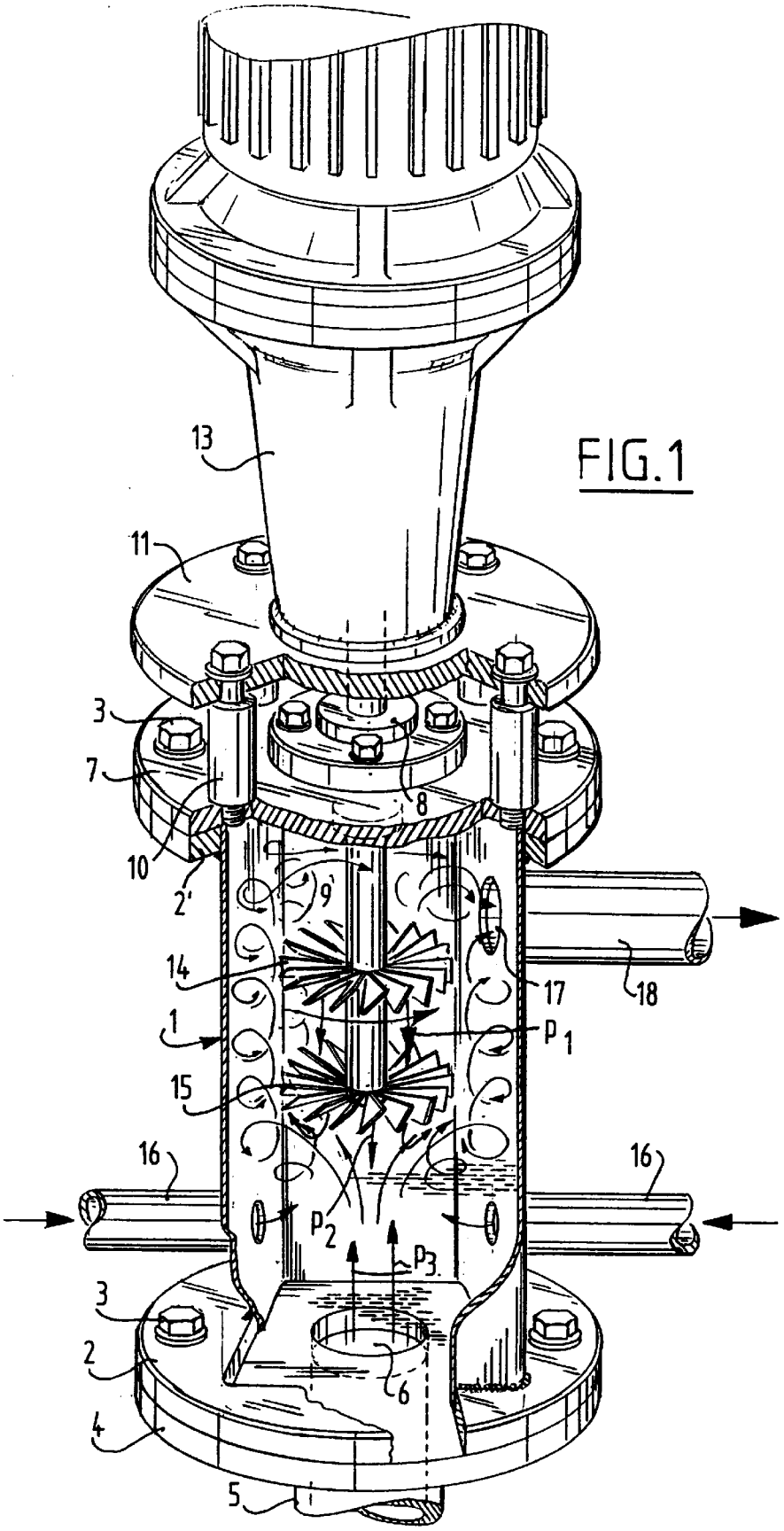
FIG. 1 shows a perspective view of a first embodiment of the device according to the invention with partly broken away parts of the mixing housing.

Designated in FIG. 1 with the numeral 1 is the housing of the device which has a non-circular or polyoval-shaped cross section and is embodied here with a rectangular section.

On the bottom of the housing the rectangular wall connects onto an end flange 2 which can be connected by means of bolts 3 to a connecting flange 4 of a pipe system 5, such that the pipe system 5 connects onto the inlet opening 6.

Fixed on the opposite side of the housing by means of bolts 3 via a connecting flange 2' is a connection flange 7 which serves via the bearing 8 as mounting for a rotation shaft 9 extending co-axially in housing 1. Flange 7 bears a plurality of spacers 10 for fixing a flange 11 of a drive such as electric motor 13. The drive is coupled directly to rotation shaft 9 of the mixing gear. The mixing gear consists of a blade assembly formed here by two blade rotors 14, 15 placed at a mutual distance on rotation shaft 9. The blades are adjusted such that when caused to rotate in the direction of arrow P1 a pushing action as according to arrow P2 results, in the direction of inlet opening 6.

The additives are added to the housing via pipes 16, this being done into the flow P3 of the carrier liquid from inlet opening 6. After mixing, the mix leaves the housing via outlet opening 17 and discharge pipe 18.

The operation of the above described device is as follows. The carrier liquid is fed into housing 1 under pressure through inlet opening 6 via the pipe 5. The additive is simultaneously introduced via the pipes 16 and a first mixing will take place. The main flow will separate into four partial-flows which are situated substantially in the corners of the housing. A part of the liquid is fed back in the direction of arrow P2 by the axial pushing action of mixing gear 14, 15. Flows P2 and P3 will be mixed once again wherein a strong turbulent flow is formed. The intensively mixed carrier flow and the additives leave the housing via pipes 18.

Figure 2:
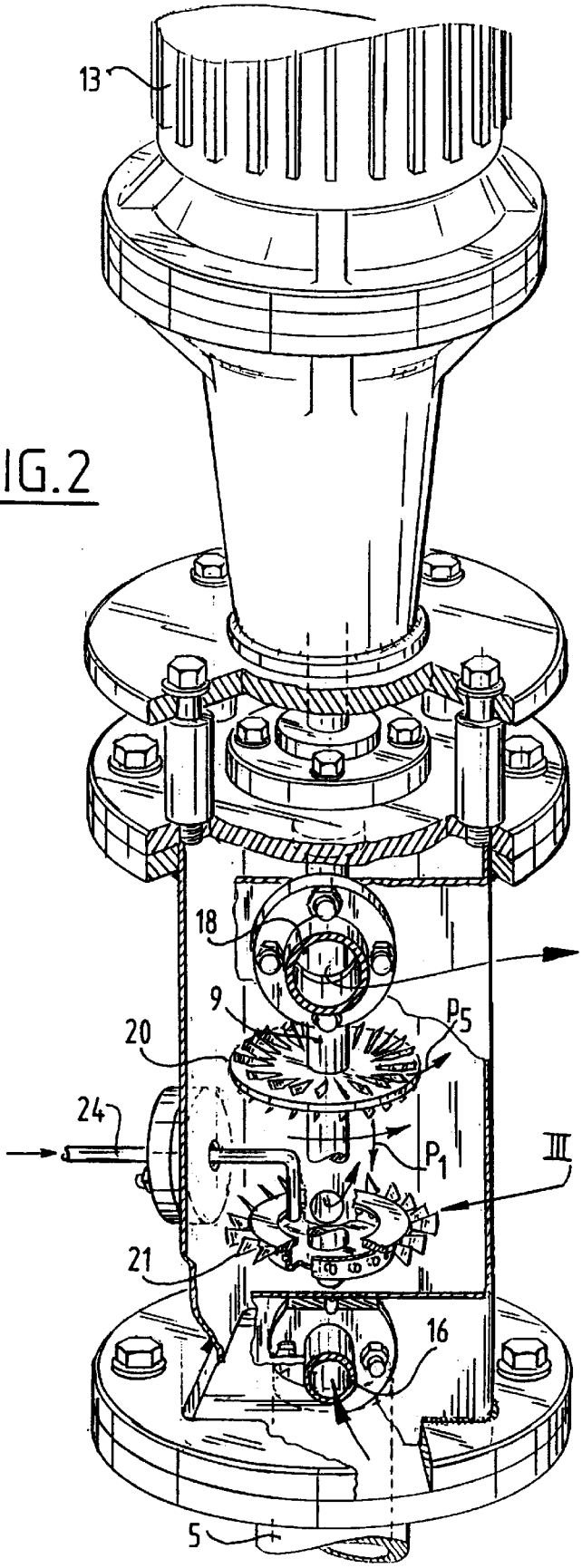
FIG. 2 shows a view corresponding with FIG. 1 of a second embodiment of the device according to the invention.

FIG. 2 shows an alternative embodiment wherein the same elements are designated with the same reference numerals.

The difference from the embodiment according to FIG. 1 is the different embodiment of the mixing gear. In FIG. 2 two rotors 20 and 21 are placed the mixing gear, a mutual distance and likewise rotated by a rotation shaft 9 in the direction of arrow P1. The left-hand rotor 20 consists of a closed disc on which are placed blades which cause a radial pushing action in the direction of arrow P5.

Figure 3:
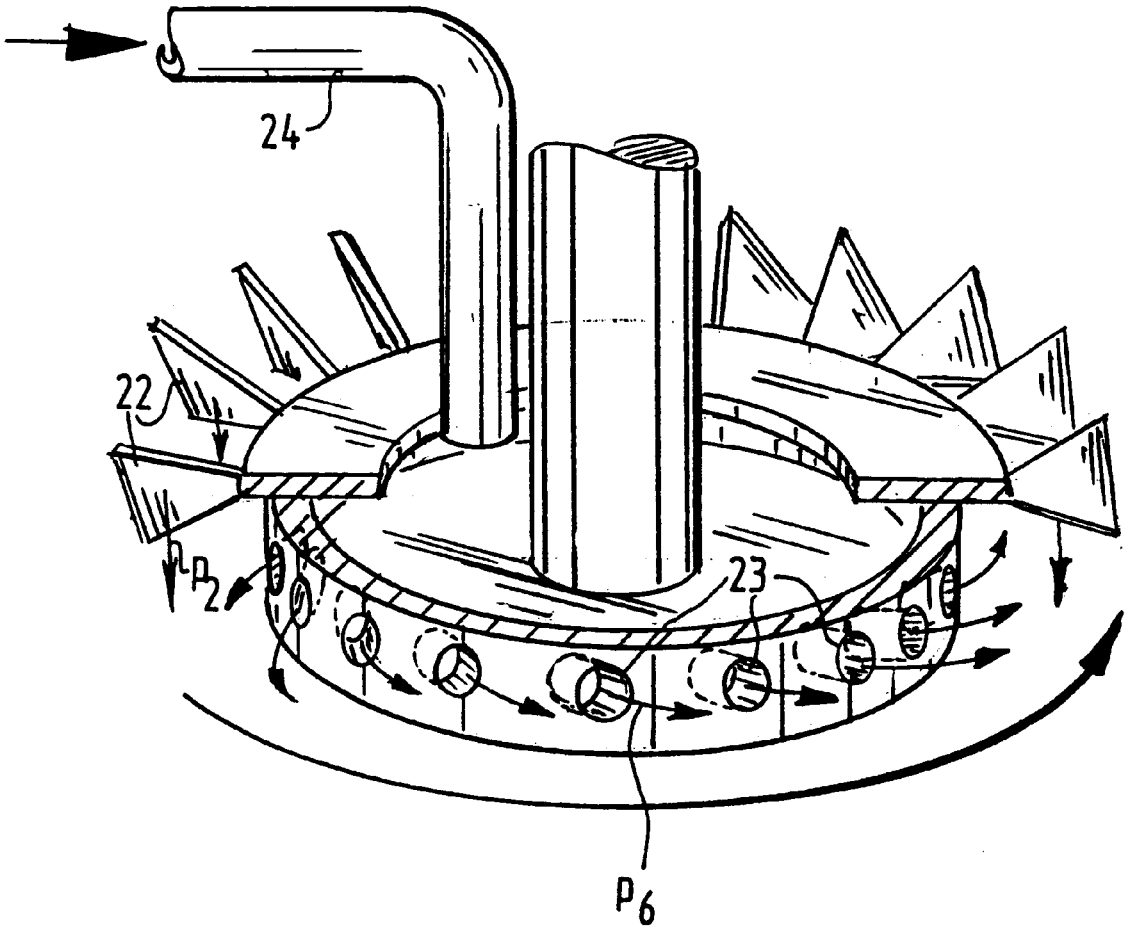
FIG. 3 shows a perspective view of a part of the blade assembly of FIG. 2.

The right-hand rotor 21 consists of a dish-shaped disc, the outer flange of which is provided with blades 22 (see FIG. 3) which cause an axial pushing action in the direction of arrow P2. The outer edge of the dish is provided with a plurality of passage openings 23 placed such that a radial pushing action as according to arrow P6 is created. Extra turbulent flows are herewith obtained along the corner parts of housing 1 and a stron- ger shearing action is brought about between these flow parts whereby a highly intensive mixing is obtained.

Another difference from the embodiment according to FIG. 1 is that a pipe 24 for an additive is fed through into the housing 1, the outer end of which debouches in the dish-shaped rotor 21. This ensures that the additive first acquires a radial flow path and is subsequently entrained in the axial flow paths.

The invention is not limited to the above described embodiments. The housing does not have to have a square cross-sectional form but may have more than four corners such as a hexagon or octagon. The housing may also have an oval form, this such that within the inventive concept one or more flow spaces are created between the imaginary peripheral cylinder of the rotors of the mixing gear and the inner side of the housing.

The position of the feed pipes 16 in the housing can also be random, wherein an additive may also be already added in the feed pipe 5 for the carrier liquid.

I claim:

1. A device for mixing a carrier liquid with one or more additives, comprising:

a closed housing defining an inlet opening and an outlet opening for the liquid and further defining an infeed port for each additive; and a mixing gear accommodated in the housing, wherein the mixing gear is formed by at least one rotatingly driven blade assembly having a rotation shaft which is positioned centrally in the housing, wherein the housing has a non-circular cross section in a horizontal plane through the housing, and wherein the mixing gear exerts a pushing action on the liquid in a direction toward the inlet opening.

2. The device as claimed in claim 1, wherein the port for the additive is defined in a side wall of the housing.

3. The device as claimed in claim 2, wherein a guide tube directed toward the rotation shaft of the blade assembly connects to the port for the additive, and wherein the guide tube is positioned substantially transverse to the rotation shaft.

4. The device as claimed in claim 3, wherein the guide tube debouches on at least one side of a leading blade assembly, the leading blade assembly spaced a distance from the inlet opening for the carrier liquid.

5. The device as claimed in claim 1, wherein the blade assembly includes a leading blade assembly spaced a distance from the inlet opening for the carrier liquid, and wherein the leading blade assembly is embodied with a part which has an axial pushing action and a part which has a radial pushing action.

6. The device as claimed in claim 5, wherein the part with the axial pushing action lies concentrically around the part with the radial pushing action.

7. The device as claimed in claim 1, wherein the port for the additive is defined in a side wall of the housing closest to the mixing gear.

8. The device as claimed in claim 1, wherein the cross section of the housing is polygonal.

9. The device as claimed in claim 1, wherein the cross section of the housing is square.

10. A device for mixing a carrier liquid with at least one additive, comprising:

a closed housing defining an inlet opening and an outlet opening for the carrier liquid and further defining an infeed port for each additive; and a mixing gear positioned in the housing, wherein the mixing gear includes at least one blade assembly driven by a rotation shaft that is centrally positioned in the housing, wherein the housing has a polygonal cross section in a horizontal plane through the housing, and wherein the mixing gear exerts a pushing action on the carrier liquid in a direction toward the inlet opening such that a main flow of liquid in the housing separates into partial flows situated substantially in the corners of the housing.

11. The device as claimed in claim 10, wherein the port for the additive is defined in a side wall of the housing.

12. The device as claimed in claim 11, wherein a guide tube directed toward the rotation shaft of the blade assembly connects to the port for the additive, and wherein the guide tube is positioned substantially transverse to the rotation shaft.

13. The device as claimed in claim 12, wherein the guide tube debouches on at least one side of a leading blade assembly, the leading blade assembly spaced a distance from the inlet opening for the carrier liquid.

14. The device as claimed in claim 10, wherein the blade assembly includes a leading blade assembly spaced a distance from the inlet opening for the carrier liquid, and wherein the leading blade assembly is embodied with a part which has an axial pushing action and a part which has a radial pushing action.

15. The device as claimed in claim 14, wherein the part with the axial pushing action lies concentrically around the part with the radial pushing action.

16. The device as claimed in claim 10, wherein the port for the additive is defined in a side wall of the housing closest to the mixing gear.

17. The device as claimed in claim 10, wherein the cross section of the housing is square.

* * * * *